US007677767B2

(12) United States Patent
Chyn

(10) Patent No.: US 7,677,767 B2
(45) Date of Patent: Mar. 16, 2010

(54) LED LAMP HAVING HIGHER EFFICIENCY

(76) Inventor: Wen-Long Chyn, 45, Erh Chiao St., Yingko Chen, Taipei Hsien (TW)

( * ) Notice: Subject to any disclaimer, the term of this patent is extended or adjusted under 35 U.S.C. 154(b) by 88 days.

(21) Appl. No.: 12/060,413

(22) Filed: Apr. 1, 2008

(65) Prior Publication Data

US 2009/0244899 A1 Oct. 1, 2009

(51) Int. Cl.
*F21V 29/00* (2006.01)

(52) U.S. Cl. ..... 362/294; 362/249.02; 362/373; 362/800

(58) Field of Classification Search ..... 362/249.02, 362/294, 373, 800
See application file for complete search history.

(56) References Cited

U.S. PATENT DOCUMENTS 6,367,943 B1 * 4/2002 Tocci et al. ..... 362/103
2007/0038206 A1 * 2/2007 Altshuler et al. ..... 606/20
2007/0253188 A1 * 11/2007 Klipstein et al. ..... 362/105

* cited by examiner

*Primary Examiner*—Laura Tso
(74) *Attorney, Agent, or Firm*—Alan Kamrath; Kamrath & Associates PA

(57) ABSTRACT

An LED lamp includes a heatsink housing, a heatsink plate mounted on the heatsink housing, an LED module mounted on the heatsink plate, and a circuit board mounted in the heatsink housing and electrically connected to the LED module. Thus, when the LED module is operated, the heat produced by the LED module is transferred by a heat conduction of the heatsink plate and by a heat convection between the heatsink plate and the heatsink housing, so that the heat produced by the LED module is carried away exactly and quickly, thereby enhancing the heat dissipation effect of the LED module.

18 Claims, 4 Drawing Sheets

LED LAMP HAVING HIGHER EFFICIENCY

BACKGROUND OF THE INVENTION

1. Field of the Invention

The present invention relates to a lamp and, more particularly, to an LED (light emitting diode) lamp to provide a lighting function.

2. Description of the Related Art

A conventional LED lamp comprises an LED (light emitting diode) to provide a lighting function. However, the LED is a heat source and easily produces a high temperature during operation, so that it is necessary to provide a heat sink to carry away the heat produced by the LED so as to achieve a heat dissipation effect. A conventional heat sink generally comprises a heatsink element, such as a metallic heatsink fin, a heat conductive tube, a chill enabling chip, a heat dissipation board, a cooling fan and the like, so as to achieve a heat dissipation effect. However, the conventional heat sink cannot dissipate the heat from the heat source exactly and quickly, thereby greatly decreasing the heat dissipation efficiency. In addition, the conventional heat sink has a very complicated construction, thereby increasing the costs of fabrication.

BRIEF SUMMARY OF THE INVENTION

In accordance with the present invention, there is provided an LED (light emitting diode) lamp, comprising a heatsink housing, a heatsink plate mounted on the heatsink housing, an LED module mounted on the heatsink plate, and a circuit board mounted in the heatsink housing and electrically connected to the LED module.

The primary objective of the present invention is to provide an LED lamp having a higher efficiency.

Another objective of the present invention is to provide an LED lamp having a greater heatsink effect.

A further objective of the present invention is to provide an LED lamp, wherein when the LED module is operated, the heat produced by the LED module is transferred by a heat conduction of the heatsink plate and by a heat convection between the heatsink plate and the heatsink housing, so that the heat produced by the LED module is carried away exactly and quickly, thereby enhancing the heat dissipation effect of the LED module.

A further objective of the present invention is to provide an LED lamp, wherein the heatsink housing has a heat radiation function to enhance the heat dissipation effect of the LED module.

A further objective of the present invention is to provide an LED lamp, wherein the heatsink housing is provided with a metallic screw base, an insulating gasket and a power contact plate so that the heatsink housing can be mounted on a traditional receptacle to replace the conventional electric bulb.

A further objective of the present invention is to provide an LED lamp, wherein the heatsink plate has a surface provided with a plurality of ventilating holes connected to the receiving space of the heatsink housing to enhance a heat convection effect between the heatsink plate and the heatsink housing.

A further objective of the present invention is to provide an LED lamp, wherein the heatsink housing has a surface provided with a plurality of heatsink grooves to increase a surface area of the heatsink housing so as to enhance the heat dissipation effect of the heatsink housing.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
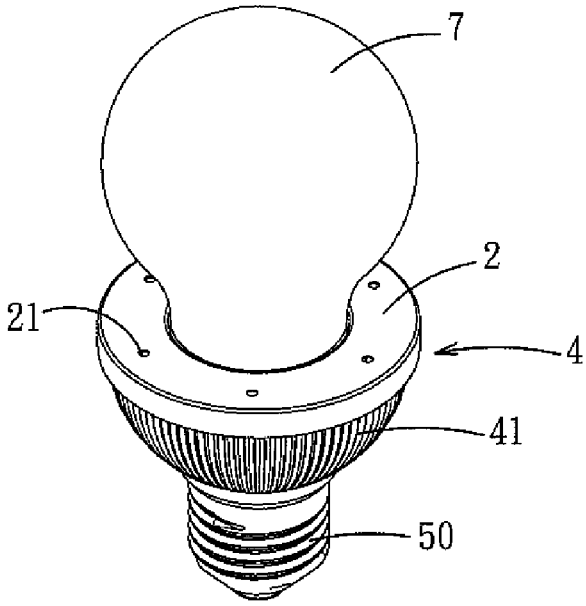
FIG. 1 is a perspective view of an LED lamp in accordance with the preferred embodiment of the present invention.
Figure 3:
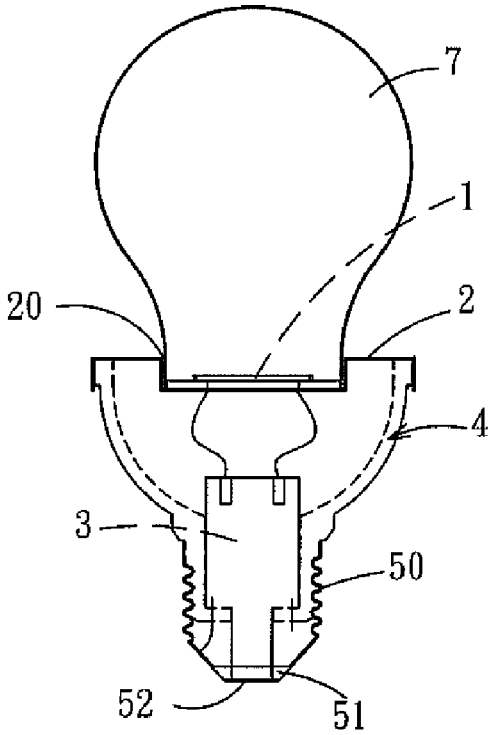
FIG. 3 is a front view of the LED lamp as shown in FIG. 1.
Figure 2:
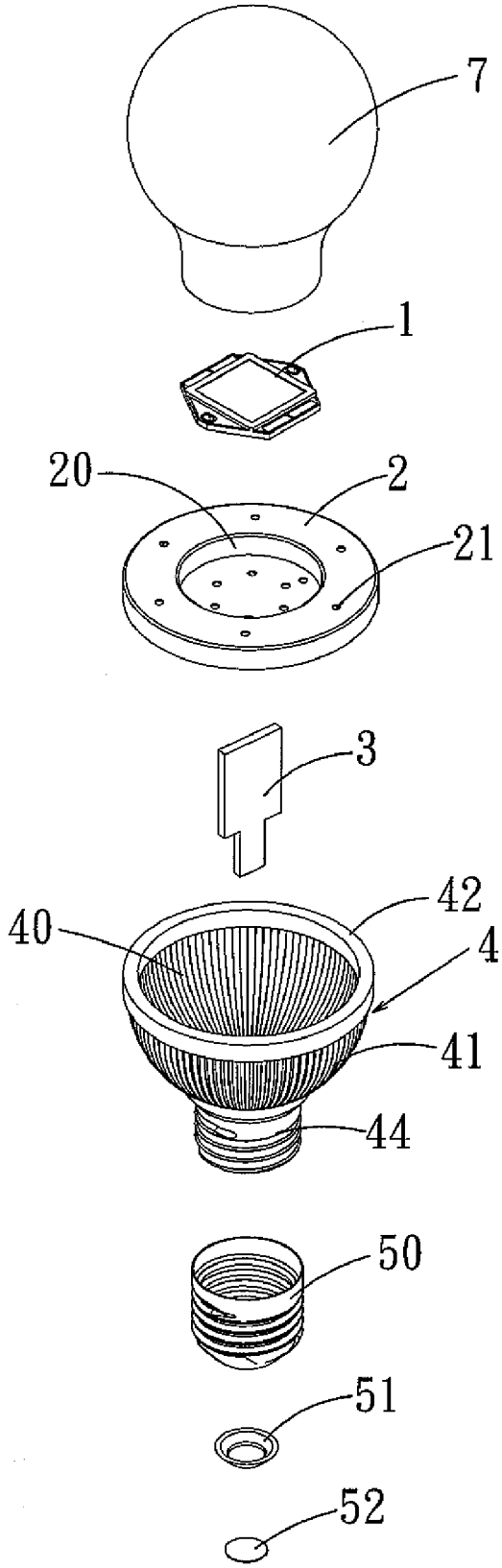
FIG. 2 is an exploded perspective view of the LED lamp as shown in FIG. 1.

Referring to the drawings and initially to FIGS. 1-3, an LED (light emitting diode) lamp in accordance with the preferred embodiment of the present invention comprises a heatsink housing 4, a heatsink plate 2 mounted on the heatsink housing 4, an LED module 1 mounted on the heatsink plate 2, and a circuit board 3 mounted in the heatsink housing 4 and electrically connected to the LED module 1 to electrically connect the LED module 1 to an external power supply (not shown). The LED lamp further comprises a lamp shade 7 mounted on the heatsink plate 2 to encompass the LED module 1.

The heatsink housing 4 forms a porous structure with a greater heat dissipation feature. The porous structure formed by the heatsink housing 4 has a high specific surface area and is made of a nonmetallic powder (formed by an injection molding process) having greater heat conductivity, such as $Al_2O_3$, $Zr_2O$, AlN, SiN, BN, WC, C, SiC, crystalline SiC, Recrystalline SiC (ReSiC) and the like.

The heatsink housing 4 has a substantially semi-spherical profile and has a first end provided with an opening 42 for mounting the heatsink plate 2 and a second end provided with a threaded stud 44 for mounting a metallic screw base 50, an insulating gasket 51 and a power contact plate 52 with a specification of E-27, E-14 and the like. The metallic screw base 50 and the power contact plate 52 are electrically connected to the circuit board 3 so that the circuit board 3 is electrically connected between the LED module 1, the metallic screw base 50 and the power contact plate 52.

The heatsink housing 4 has an inside provided with a receiving space 40. Thus, by provision of the porous structure formed by the heatsink housing 4, the air contained in the receiving space 40 of the heatsink housing 4 can pass through the heatsink housing 4 to produce a greater heat convection effect. The receiving space 40 of the heatsink housing 4 is located between the opening 42 and the threaded stud 44. The heatsink housing 4 has a surface provided with a plurality of heatsink grooves 41 which are parallel with each other and are connected to the receiving space 40 to increase a surface area of the heatsink housing 4 so as to enhance the heat dissipation effect of the heatsink housing 4. The heatsink grooves 41 of the heatsink housing 4 are located between the opening 42 and the threaded stud 44.

The heatsink plate 2 is mounted on the opening 42 of the heatsink housing 4 to seal the opening 42 of the heatsink housing 4. The heatsink plate 2 is made of a metal having greater heat conductivity, such as gold, silver, copper, iron, aluminum, cobalt, nickel, zinc, titanium, manganese and the like. The heatsink plate 2 has an inside provided with a receiving chamber 20 to receive the LED module 1, and the lamp shade 7 has an end portion mounted in the receiving chamber 20 of the heatsink plate 2. The heatsink plate 2 has a surface provided with a plurality of ventilating holes 21 connected to the receiving space 40 of the heatsink housing 4 to enhance a heat convection effect between the heatsink plate 2 and the heatsink housing 4.

The circuit board 3 is mounted in the receiving space 40 of the heatsink housing 4 and is located between the heatsink housing 4 and the heatsink plate 2.

In operation, when the LED module 1 is operated, the heat produced by the LED module 1 is transferred by a heat conduction of the heatsink plate 2 and by a heat convection between the heatsink plate 2 and the heatsink housing 4, so that the heat produced by the LED module 1 is carried away exactly and quickly, thereby enhancing the heat dissipation effect of the LED module 1.

In such a manner, the heatsink housing 4 has a heat radiation function to enhance the heat dissipation effect of the LED module 1. In addition, the heatsink housing 4 is provided with a metallic screw base 50, an insulating gasket 51 and a power contact plate 52 so that the heatsink housing 4 can be mounted on a traditional receptacle to replace the conventional electric bulb.

Figure 4:
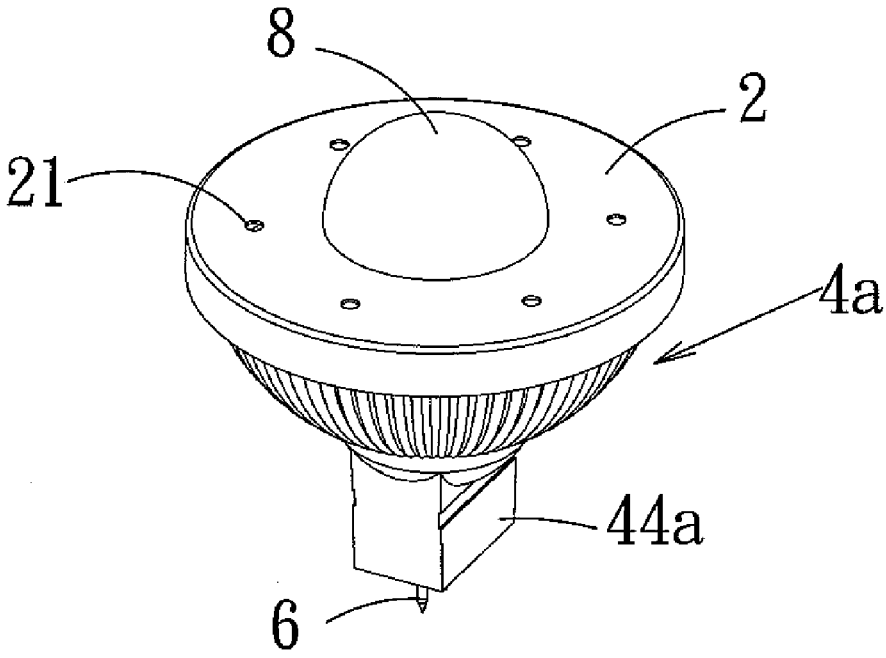
FIG. 4 is a perspective view of an LED lamp in accordance with another preferred embodiment of the present invention.
Figure 6:
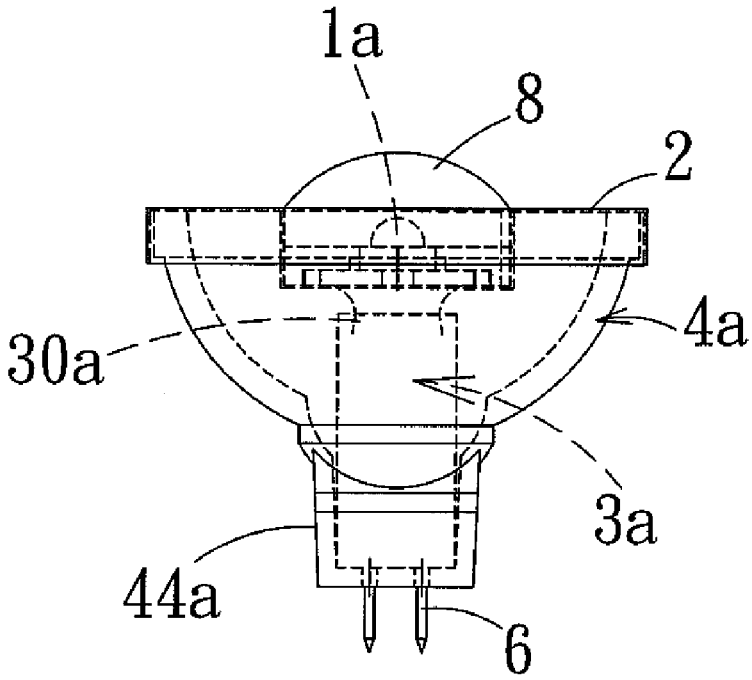
FIG. 6 is a front view of the LED lamp as shown in FIG. 4.
Figure 5:
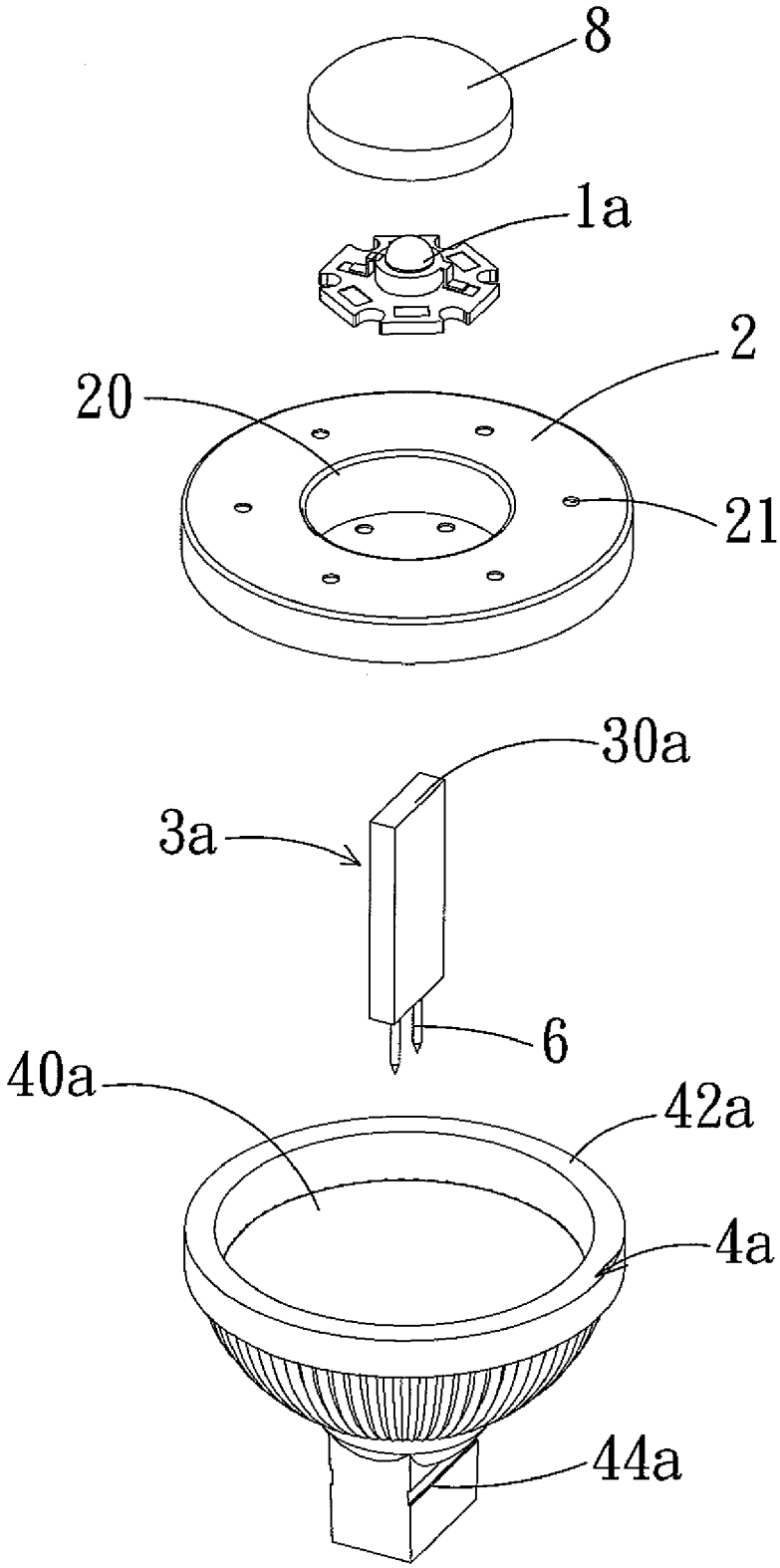
FIG. 5 is an exploded perspective view of the LED lamp as shown in FIG. 4.

Referring to FIGS. 4-6, the LED lamp further comprises a reflective shade 8 mounted on the heatsink plate 2 to encompass the LED module 1*a*. The heatsink housing 4*a* has a first end provided with an opening 42*a* for mounting the heatsink plate 2 and a second end provided with a rectangular mounting stud 44*a*. The heatsink housing 4*a* has an inside provided with a receiving space 40*a*. The circuit board 3*a* has a first end 30*a* electrically connected to the LED module 1*a* and a second end provided with two connecting pins 6 (with a specification of MR16 and the like) protruding outwardly from the mounting stud 44*a* of the heatsink housing 4*a* to electrically connect the LED module 1*a* to an external power supply (not shown).

Accordingly, when the LED module 1 is operated, the heat produced by the LED module 1 is transferred by a heat conduction of the heatsink plate 2 and by a heat convection between the heatsink plate 2 and the heatsink housing 4, so that the heat produced by the LED module 1 is carried away exactly and quickly, thereby enhancing the heat dissipation effect of the LED module 1. In addition, the heatsink housing 4 has a heat radiation function to enhance the heat dissipation effect of the LED module 1. Further, the heatsink housing 4 is provided with a metallic screw base 50, an insulating gasket 51 and a power contact plate 52 so that the heatsink housing 4 can be mounted on a traditional receptacle to replace the conventional electric bulb. Further, the heatsink plate 2 has a surface provided with a plurality of ventilating holes 21 connected to the receiving space 40 of the heatsink housing 4 to enhance a heat convection effect between the heatsink plate 2 and the heatsink housing 4. Further, the heatsink housing 4 has a surface provided with a plurality of heatsink grooves 41 to increase a surface area of the heatsink housing 4 so as to enhance the heat dissipation effect of the heatsink housing 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An LED (light emitting diode) lamp, comprising:
a heatsink housing;
a heatsink plate mounted on the heatsink housing;
an LED module mounted on the heatsink plate;
a circuit board mounted in the heatsink housing and electrically connected to the LED module;
wherein the heatsink housing has a first end provided with an opening for mounting the heatsink plate;
the heatsink housing has a second end provided with a threaded stud for mounting a metallic screw base, an insulating gasket and a power contact plate;
the metallic screw base and the power contact plate are electrically connected to the circuit board so that the circuit board is electrically connected between the LED module, the metallic screw base and the power contact plate.

2. An LED (light emitting diode) lamp, comprising:
a heatsink housing;
a heatsink plate mounted on the heatsink housing;
an LED module mounted on the heatsink plate;
a circuit board mounted in the heatsink housing and electricalty connected to the LED module;
wherein the heatsink housing has a first end provided with an opening for mounting the heatsink plate;
the heatsink housing has a second end provided with a mounting stud;
the circuit board has a first end electrically connected to the LED module and a second end provided with two connecting pins protruding outwardly from the mounting stud of the heatsink housing.

3. An LED (light emitting diode) lamp, comprising:
a heatsink housing;
a heatsink plate mounted on the heatsink housing;
an LED module mounted on the heatsink pilate;
a circuit board mounted in the heatsink housing and electrically connected to the LED module;
wherein the heatsink plate has an inside provided with a receiving chamber to receive the LED module.

4. The LED lamp in accordance with claim 1 wherein the heatsink housing forms a porous structure with a heat dissipation feature.

5. The LED lamp in accordance with claim 4, wherein the heatsink housing has an inside provided with a receiving space.

6. The LED lamp in accordance with claim 5, wherein the heatsink housing has a surface provided with a plurality of heatsink grooves which are connected to the receiving space to increase a surface area of the heatsink housing.

7. The LED lamp in accordance with claim 5, wherein the heatsink plate has a surface provided with a plurality of ventilating holes connected to the receiving space of the heatsink housing to enhance a heat convection effect between the heatsink plate and the heatsink housing.

8. The LED lamp in accordance with claim 4, wherein the porous structure formed by the heats ink housing is made of a nonmetallic powder having greater heat conductivity.

9. The LED lamp in accordance with claim 1, wherein the heatsink housing has a substantially semi-spherical profile.

10. The LED lamp in accordance with claim 6, wherein the heatsink grooves of the heatsink housing are parallel with each other.

11. The LED lamp in accordance with claim 6, wherein the heatsink grooves of the heatsink housing are located between the opening and the threaded stud.

12. The LED lamp in accordance with claim 1, wherein the heatsink plate is mounted on the opening of the heatsink housing to seal the opening of the heatsink housing.

13. The LED lamp in accordance with claim 1, wherein the heatsink plate is made of a metal having heat conductivity.

14. The LED lamp in accordance with claim 5, wherein the circuit board is mounted in the receiving space of the heatsink housing and is located between the heatsink housing and the heatsink plate.

15. The LED lamp in accordance with claim 1, further comprising:

a lamp shade mounted on the heatsink plate to encompass the LED module.

16. The LED lamp in accordance with claim 1, further comprising:

a reflective shade mounted on the heatsink plate to encompass the LED module.

17. The LED lamp in accordance with claim 1, wherein the heatsink housing has an inside provided with a receiving space located between the opening and the threaded stud.

18. The LED lamp in accordance with claim 2, wherein the heatsink housing has an inside provided with a receiving space located between the opening and the mounting stud.

* * * * *